US008925319B2

(12) United States Patent
Snider et al.

(10) Patent No.: US 8,925,319 B2
(45) Date of Patent: Jan. 6, 2015

(54) STEAM FLOW CONTROL SYSTEM

(75) Inventors: David August Snider, Simpsonville, SC (US); Scott Victor Hannula, Westminster, MA (US)

(73) Assignee: General Electric Company, Schenectady, NY (US)

( * ) Notice: Subject to any disclaimer, the term of this patent is extended or adjusted under 35 U.S.C. 154(b) by 217 days.

(21) Appl. No.: 13/588,127

(22) Filed: Aug. 17, 2012

(65) Prior Publication Data

US 2014/0047840 A1 Feb. 20, 2014

(51) Int. Cl.
*F01K 13/02* (2006.01)

(52) U.S. Cl.
USPC ..... 60/660; 60/641.1; 60/641.8

(58) Field of Classification Search
CPC . F01K 13/0034; F01K 13/006; F01K 13/003; F22B 35/004
USPC ..... 60/660, 39.281, 243, 240, 641.8, 641.1
See application file for complete search history.

(56) References Cited

U.S. PATENT DOCUMENTS 4,178,762 A * 12/1979 Binstock et al. ..... 60/660
4,461,152 A * 7/1984 Tennichi et al. ..... 60/660
4,474,012 A * 10/1984 Chamberlain ..... 60/660
4,561,254 A * 12/1985 Martens et al. ..... 60/660
4,811,565 A * 3/1989 Hwang ..... 60/660
5,873,235 A 2/1999 Bosley et al.
6,526,358 B1 2/2003 Mathews et al.
7,400,967 B2 7/2008 Ueno
7,481,061 B2 1/2009 Gadde et al.
7,549,293 B2 6/2009 Gallagher et al.
7,707,814 B2 5/2010 Sonoda et al.
7,836,676 B2 11/2010 Futa, Jr. et al.
8,505,299 B2 * 8/2013 Mundra et al. ..... 60/660
8,538,657 B2 9/2013 Snider
2003/0094000 A1 5/2003 Zagranski et al.
2003/0192300 A1 10/2003 Mahoney et al.
2003/0201132 A1 10/2003 Mikrut
2004/0011050 A1 1/2004 Inoue
2004/0114666 A1 6/2004 Hardwicke et al.
2006/0150633 A1 7/2006 McGinley et al.
2006/0201132 A1 9/2006 Hirayama et al.
2007/0028602 A1 2/2007 Dalla Betta et al.
2007/0101724 A1 5/2007 Gadde et al.
2008/0041063 A1 2/2008 Feiz
2008/0243401 A1 10/2008 Viele (Continued)

OTHER PUBLICATIONS

Mar-Coleman, U.S. Appl. No. 12/432,867, Office Action Communication, 19441-0340, Sep. 28, 2011, 11 pages.

(Continued)

*Primary Examiner* — Kenneth Bomberg
*Assistant Examiner* — Shafiq Mian
(74) *Attorney, Agent, or Firm* — Ernest G. Cusick; Hoffman Warnick LLC

(57) ABSTRACT

Systems and methods for model based steam flow control to and/or through a steam turbine component are disclosed. In one embodiment, a system includes: at least one computing device configured to control a steam flow in a power generation system by performing actions comprising: generating a flow model for the steam flow based at least in part on operational data about the steam flow in the power generation system; and adjusting a characteristic of the steam flow based upon the flow model.

6 Claims, 7 Drawing Sheets

(56) References Cited

U.S. PATENT DOCUMENTS

| | | | | |
|---|---|---|---|---|
| 2008/0310949 | A1 | 12/2008 | Kondo et al. | |
| 2009/0217665 | A1* | 9/2009 | Holzhauer et al. | 60/645 |
| 2009/0271085 | A1 | 10/2009 | Buchalter et al. | |
| 2009/0288414 | A1* | 11/2009 | Takeshita et al. | 60/645 |
| 2010/0107603 | A1 | 5/2010 | Smith | |
| 2010/0122535 | A1 | 5/2010 | Finkbeiner | |
| 2010/0252009 | A1 | 10/2010 | Barth et al. | |
| 2011/0146276 | A1* | 6/2011 | Sathyanarayana et al. | 60/646 |

OTHER PUBLICATIONS

Mar-Coleman, U.S. Appl. No. 12/432,867, Office Action Communication, 19441-0340, Jul. 30, 2012, 9 pages.
Mar-Coleman, U.S. Appl. No. 12/432,867, Office Action Communication, 19441-0340, Feb. 27, 2012, 13 pages.
U.S. Appl. No. 12/432,867, Office Action, Dec. 18, 2012, 9 pages.
U.S. Appl. No. 12/432,867, Notice of Allowance and Fees Due, May 20, 2013, 8 pages.

* cited by examiner

STEAM FLOW CONTROL SYSTEM

CROSS-REFERENCE TO RELATED APPLICATION

This application relates to U.S. patent application Ser. No. 12/432,867, (Publication No. US 2010/0280731 A1) filed 30 Apr. 2009, entitled SYSTEMS AND METHODS FOR CONTROLLING FUEL FLOW TO A TURBINE COMPONENT, currently pending.

BACKGROUND OF THE INVENTION

The subject matter disclosed herein relates to power generation systems and, more particularly, to methods and systems for adaptively controlling steam flow (e.g., operational steam flow) to and/or through a steam turbine in a power generation system.

Some power generation systems, for example certain nuclear, simple-cycle and combined-cycle power plant systems, employ steam turbines in their design and operation. These steam turbines are driven by a flow of steam which rotates a rotor of the steam turbine and thereby creates rotary motion for use and conversion by power generation systems and generators. The flow of steam through the steam turbine is controlled in part by a set of control valves which regulate the rate at which the steam flow is introduced through a compressible steam volume. As steam is compressible in nature, the responsiveness of the steam flow does not immediately correlate to control valve adjustments and as a result there is some lag in system response and performance during valve adjustments. Thus, in these systems, when a position of a control valve is adjusted there is a transitory period through which the actual steam flow rate gradually adjusts from a first steam flow rate (e.g., the flow rate of the system with the first control valve position) to a second steam flow rate (e.g., the flow rate of the system with the adjusted control valve position). To account for this lag in steam flow adjustment and to prevent over response/undershooting by the control valves, control systems typically rate limit movements of the control valves, adjusting valve position in a smooth progressive fashion. However, these rate limited movements may lead to inefficient operation, prolonged valve adjustments, lags in system response, a lack of system versatility, delayed output adjustments, and limited operational applications (e.g., steam turbine use in island mode operations).

BRIEF DESCRIPTION OF THE INVENTION

Systems and methods for model based steam flow control to and/or through a steam turbine component are disclosed. In one embodiment, a system includes: at least one computing device configured to control a steam flow in a power generation system by performing actions comprising: generating a flow model for the steam flow based at least in part on operational data about the steam flow in the power generation system; and adjusting a characteristic of the steam flow based upon the flow model.

A first aspect of the invention provides a system including: at least one computing device configured to control a steam flow in a power generation system by performing actions comprising: generating a flow model for the steam flow based at least in part on operational data about the steam flow in the power generation system; and adjusting a characteristic of the steam flow based upon the flow model.

A second aspect of the invention provides a program product stored on a computer readable medium, which when executed by at least one computing device, performs actions including: generates a flow model for a steam flow in a power generation system based at least in part on operational data about the steam flow in the power generation system; and adjusts a characteristic of the steam flow based upon the flow model.

A third aspect of the invention provides a steam turbine control system including: at least one sensor adapted to obtain operational data for a steam flow in a power generation system; and a computing device communicatively connected to the at least one sensor and configured to process the operational data to generate a flow model for the steam flow, the computing device further configured to adjust a characteristic of the steam flow based at least in part on the flow model.

BRIEF DESCRIPTION OF THE DRAWINGS

These and other features of this invention will be more readily understood from the following detailed description of the various aspects of the invention taken in conjunction with the accompanying drawings that depict various embodiments of the invention, in which.

Figure 1:
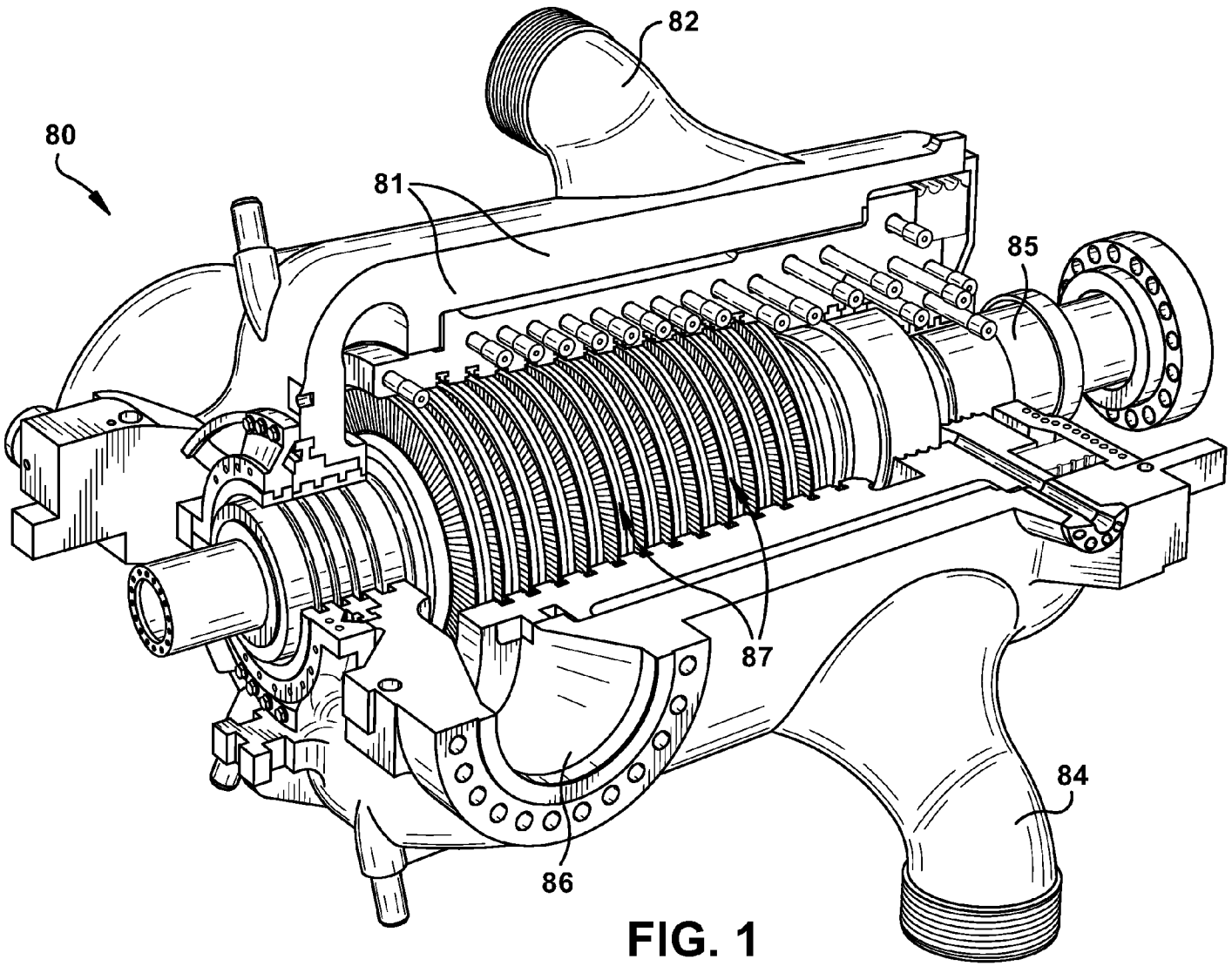
FIG. 1 shows a schematic side view of a steam turbine in accordance with an aspect of the invention.

It is noted that the drawings of the disclosure may not necessarily be to scale. The drawings are intended to depict only typical aspects of the disclosure, and therefore should not be considered as limiting the scope of the disclosure. In the drawings, like numbering represents like elements between the drawings.

DETAILED DESCRIPTION OF THE INVENTION

As indicated herein, aspects of the invention provide for systems and methods configured to adaptively model and control steam flow to and/or through a steam turbine component. These systems and methods model steam flow characteristics (e.g., flow volume, flow pressure, etc.) based upon operational data obtained from the steam turbine, and use this model to control and adjust steam flow in power generation systems.

Operation of some power generation systems may include regulation and incremental adjustment of a flow of steam to a steam turbine. This regulation and/or adjustment of the steam flow typically includes the use of a set of actuators and control valves which are adjusted by a control system to modify the steam flow rate. In transitioning from a first steam flow rate to a second steam flow rate, the control system gradually adjusts a position of the control valves from a first position to a second position so as to account for the delayed response of the steam flow and to prevent over response by the control valves. However, this gradual adjustment may lead to inefficient operation, prolonged valve adjustments, delayed system response, a lack of system versatility, and may also limit operational applications.

In contrast to the conventional system, embodiments of the current invention provide systems and methods which model steam flow characteristics through a power generation system based on operational data (e.g., steam flow rate, steam flow temperature, steam flow pressure, control valve positions, steam volume temperature, steam volume pressure, steam extraction flows, rotor speed, proximity probe data, etc.) and use the generated flow models to guide responsive and stable operation (e.g., adjustment of control valves, adjustment of steam flow rates, etc.) of the power generation system. These model based control systems and methods may include a computing device which is communicatively connected to a database/memory/storage system and at least one sensor disposed on the steam turbine. The computing device is configured to process operational data obtained by the at least one sensor and generate flow models (e.g., pressure decay, flow rate variation, etc.) for steam flow in the power generation system. In one embodiment, these flow models are thermodynamic models which may include time dependent heat transfer and/or unbalanced torque/acceleration representations. These flow models may include uni-variate curves which are adjusted based upon real time data obtained from sensors during operation. The computing device uses these flow models to predict/account for potential changes (e.g., pressure fluctuations, control valve adjustments, etc.) in the power generation system and project the effects (e.g., steam pressure decay, increase in response to valve adjustments, etc.) that these potential changes would have on the steam flow. The computing device then controls plant operations (e.g., valve stroke rates, actuator responses, etc.) based on analysis of these flow models.

As will be appreciated by one skilled in the art, the control systems and methods described herein may be embodied as a system(s), method(s), operator display (s) or computer program product(s), e.g., as part of a power plant system, a power generation system, a turbine system, etc. Accordingly, embodiments of the present invention may take the form of an entirely hardware embodiment, an entirely software embodiment (including firmware, resident software, micro-code, etc.) or an embodiment combining software and hardware aspects that may all generally be referred to herein as a "circuit," "module," "network" or "system." Furthermore, the present invention may take the form of a computer program product embodied in any tangible medium of expression having computer-usable program code embodied in the medium.

Any combination of one or more computer usable or computer readable medium(s) may be utilized. The computer-useable or computer-readable medium may be, for example but not limited to, an electronic, magnetic, optical, electromagnetic, infrared, or semiconductor system, apparatus, or device. More specific examples (a non-exhaustive list) of the computer-readable medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a transmission media such as those supporting the Internet or an intranet, or a magnetic storage device. Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory. In the context of this document, a computer-usable or computer-readable medium may be any medium that can contain, store, communicate, or transport the program for use by or in connection with the instruction execution system, apparatus, or device. The computer-usable medium may include a propagated data signal with the computer-usable program code embodied therewith, either in baseband or as part of a carrier wave. The computer usable program code may be transmitted using any appropriate medium, including but not limited to wireless, wireline, optical fiber cable, RF, etc.

Computer program code for carrying out operations of the present invention may be written in any combination of one or more programming languages, including an object oriented programming language such as Java, Smalltalk, C++ or the like and conventional procedural programming languages, such as the "C" programming language or similar programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider).

These computer program instructions may also be stored in a computer-readable medium that can direct a computer or other programmable data processing apparatus to function in a particular manner, such that the instructions stored in the computer-readable medium produce an article of manufacture including instruction means which implement the function/act specified in the block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide processes for implementing the functions/acts specified in the flowchart and/or block diagram block or blocks.

Turning to the FIGURES, embodiments of a system configured to enable responsive operation and model based control of a steam turbine system, by modeling steam flow through the system and controlling system adjustments based on this flow model are shown. Each of the components in the FIGURES may be connected via hardwired, wireless, or other conventional means as is indicated in FIGS. 1-7. Specifically, referring to FIG. 1, a cross-sectional view of a steam turbine 80 including a casing 81 with a first steam inlet 82 and a second steam inlet 84 is shown. During operation, steam may flow from a steam source (shown in FIG. 2) into casing 81 via first steam inlet 82 and/or second steam inlet 84. Within casing 81, the steam may drive/be directed through a set of rotor blades 87 which are connected to a rotor 85. After passing through set of rotor blades 87 the steam may exit turbine 80 via an exhaust outlet 86. Introduction and flow of steam through turbine 80, first steam inlet 82 and/or second steam inlet 84 may be controlled by a set of control valves and the steam flow control system described herein.

Figure 2:
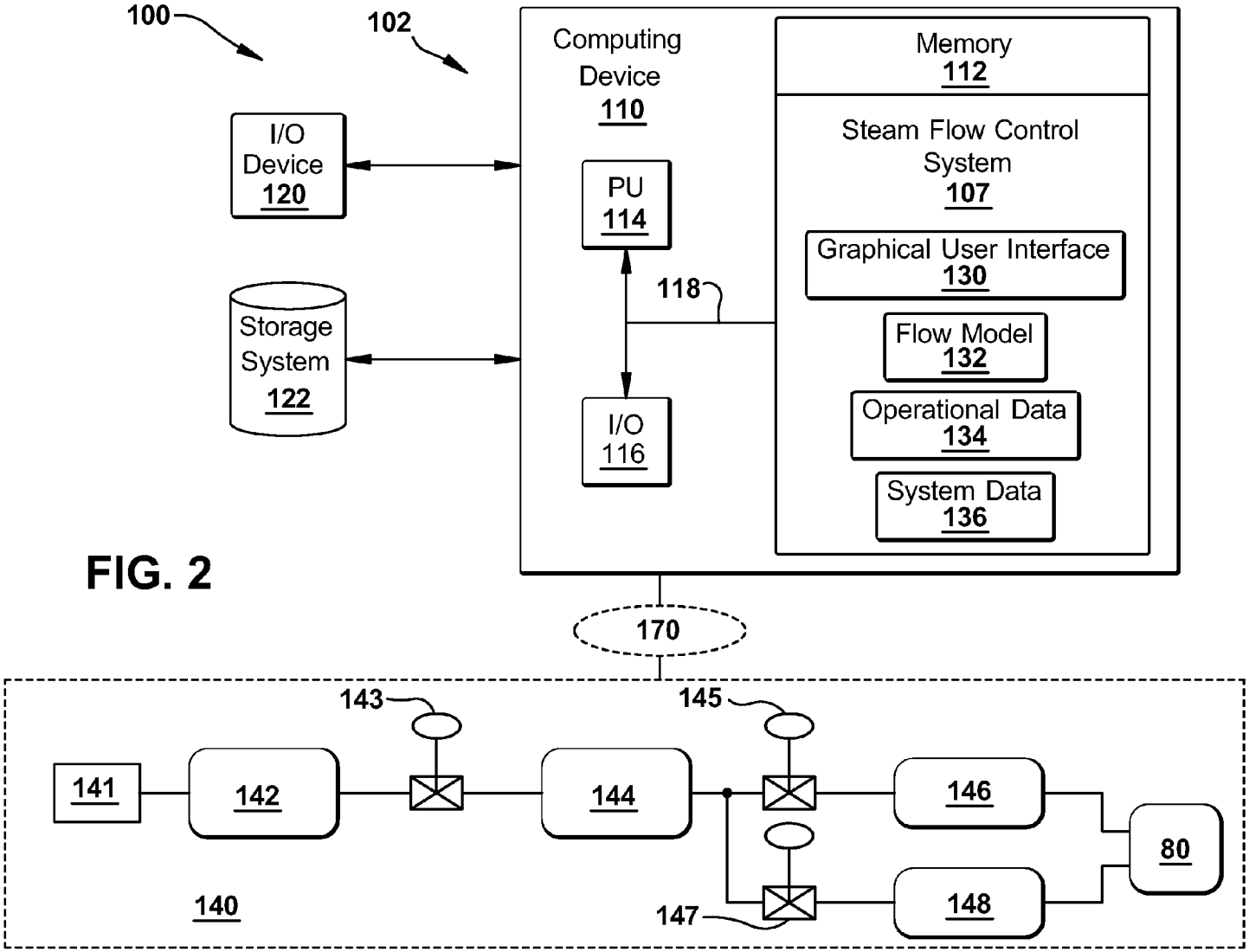
FIG. 2 shows a schematic illustration of an environment including a control system in accordance with an embodiment of the invention.
Figure 3:
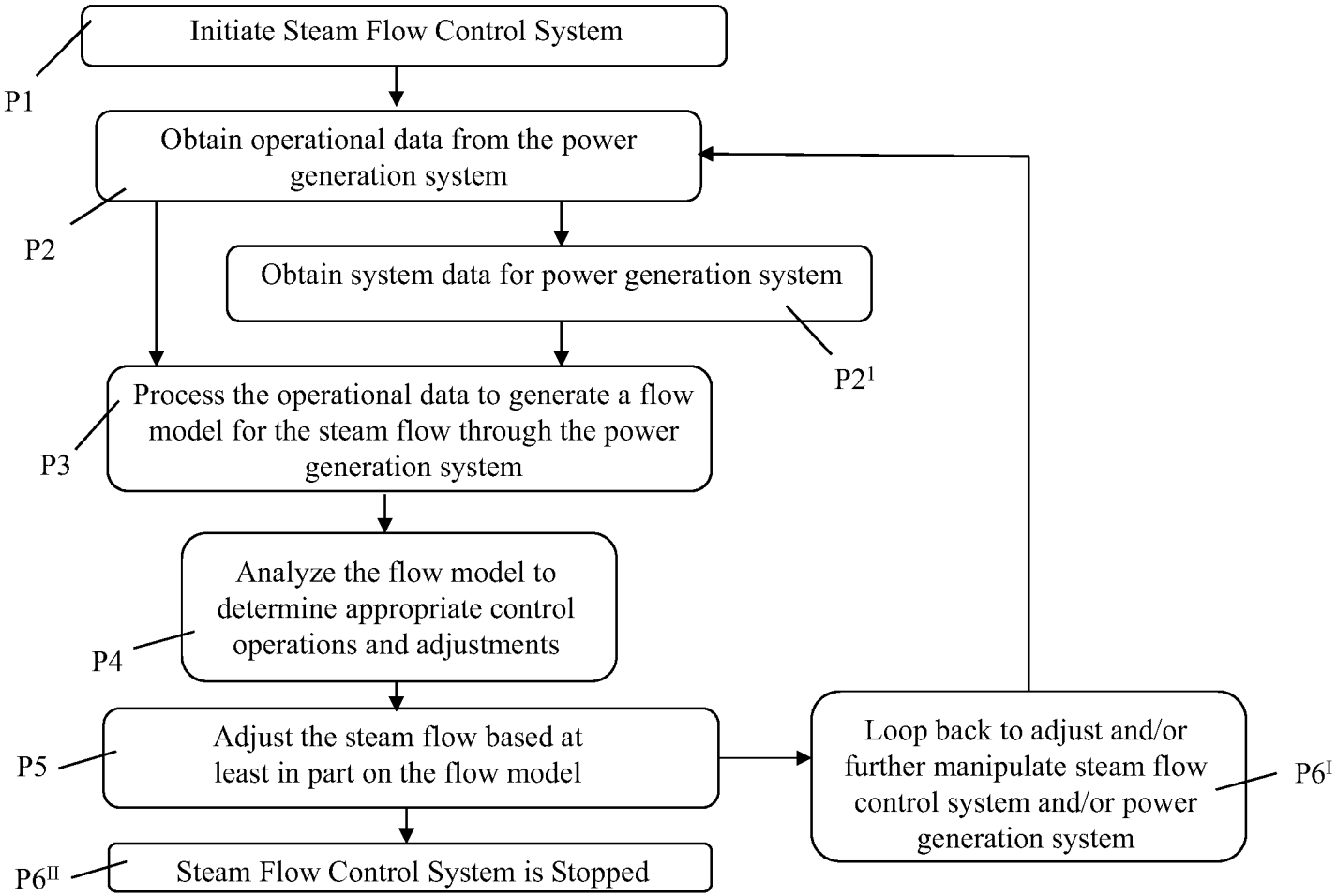
FIG. 3 shows a method flow diagram illustrating a process according to embodiments of the invention.

Turning to FIG. 2, an illustrative environment 100 including a steam flow control system 107 is shown according to embodiments of the invention. It is understood that elements similarly numbered between FIG. 1 and FIG. 2 may be substantially similar as described with reference to FIG. 1. Further, in embodiments shown and described with reference to FIGS. 2-7, like numbering may represent like elements. Redundant explanation of these elements has been omitted for clarity. Finally, it is understood that the components of FIGS. 1-7 and their accompanying descriptions may be applied to any embodiment described herein.

Returning to FIG. 2, environment 100 includes a computer infrastructure 102 that can perform the various processes described herein. In particular, computer infrastructure 102 is shown including computing device 110 which includes steam flow control system 107, which enables computing device 110 to model and control steam flow characteristics within power generation system 140 by performing the process steps of the disclosure.

As previously mentioned and discussed further below, steam flow control system 107 has the technical effect of enabling computing device 110 to perform, among other things, the steam flow model and control operations described herein. It is understood that some of the various components shown in FIG. 2 can be implemented independently, combined, and/or stored in memory for one or more separate computing devices that are included in computing device 110. Further, it is understood that some of the components and/or functionality may not be implemented, or additional schemas and/or functionality may be included as part of steam flow control system 107.

Computing device 110 is shown including a memory 112, a processor unit (PU) 114, an input/output (I/O) interface 116, and a bus 118. Further, computing device 110 is shown in communication with an external I/O device/resource 120 and a storage system 122. As is known in the art, in general, PU 114 executes computer program code, such as steam flow control system 107, that is stored in memory 112 and/or storage system 122. While executing computer program code, PU 114 can read and/or write data, such as graphical user interface 130 and/or operational data 134, to/from memory 112, storage system 122, and/or I/O interface 116. Bus 118 provides a communications link between each of the components in computing device 110. I/O device 120 can comprise any device that enables a user to interact with computing device 110 or any device that enables computing device 110 to communicate with one or more other computing devices. Input/output devices (including but not limited to keyboards, displays, pointing devices, etc.) can be coupled to the system either directly or through intervening I/O controllers.

In an embodiment, environment 100 may include a power generation system 140 connected to computing device 110. In one embodiment, power generation system 140 may include a steam source 141 fluidly connected to a steam turbine 80 via a set of conduits and steam volumes 142, 144, 146, and 148. Steam flow through the set of conduits and/or between steam source 141 and steam volumes 142, 144, 146, and 148 may be controlled via a set of control valves 143, 145, and 147. Set of control valves 143, 145, and 147 may include a set of actuators and may be manipulated to adjust and/or maintain a steam pressure in any of steam volumes 142, 144, 146, 148, and/or turbine 80. It is understood that steam source 141 may include any form of steam source known, for example, a heat recovery steam generator, a steam pipeline, etc.

In one embodiment, computing device 110 may monitor operation of power generation system 140 via a set of sensors 170 which are operatively connected to power generation system 140. It is understood that sensors 170 may include any number of sensors known including: component sensors, pressure sensors, thermometers, ambient sensors, vibration sensors, hardware component sensors, etc. Sensors 170 may monitor various parameters associated with the steam flow through power generation system 140 and provide operational data 134 (e.g., steam flow rate, steam flow temperature, steam flow pressure, control valve positions, steam volume temperature, steam volume pressure, etc.) to computing device 110. Computing device 110 and steam flow control system 107 may process operational data 134 to model steam flow through power generation system 140 and generate a flow model 132.

In one embodiment, steam flow control system 107 and/or flow model 132 may account for the compressible nature of steam when the steam flow is modeled, adjusted and/or changed by steam flow control system 107 and/or computing device 110. In one embodiment, steam flow control system 107 may include compressible dynamics associated with the steam flow in flow model 132, thereby enabling flow model 132 to predict steam flow responses and response times to control valve 143, 145, and 147 adjustments. The flow model 132 generated by steam flow control system 107 may include thermodynamic representations of steam flow within power generation system 140. In one embodiment, flow model 132 may include baseline models. In another embodiment, flow model 132 may include real time, adaptive models which may enable computing device 110 to adaptively control power generation system 140 based upon the flow response predictions of flow model 132. In one embodiment, steam flow control system 107 may model volume dynamics (e.g., relationship of pressure variations between portions (e.g., steam volumes 142, 144, 146, and/or 148) of power generation system 140) associated with the steam flow. Steam flow control system 107 may monitor the time based accumulation and/or release of mass/flow from portions of power generation system 140 in order to determine resultant pressure rises or drops within portions of power generation system 140. Steam flow control system 107 may model control capabilities associated with at least one of control valves 143, 145, and 147. Flow model 132 may model projected pressure decay of the steam flow. In another embodiment, flow model 132 may model time constants for steam volumes contained in any of steam source 141 and/or steam volumes 142, 144, 146, and 148. Flow model 132 may include a model of at least one of control valves 143, 145, and 147. In another embodiment, flow model 132 may include an actuator model. It is understood that flow model 132 may be based on single, double, or multiple variables, models, and/or data sets.

In one embodiment, computing device 110 may facilitate modeling of the steam flow to steam turbine 80 or a turbine component thereof. For example, various embodiments of the invention may model the steam flow in steam turbine 80, the operation of various components of steam turbine 80, and/or the behavior of steam in one or more turbine components. This modeling by computing device 110 and/or steam flow control system 107 may be utilized to predict steam flow behavior (e.g., a change in a steam flow characteristic, steam flow pressure drop, etc.) in response to a steam flow and/or control valve adjustment. In certain embodiments, explained in greater detail herein, the modeling of the steam flow by computing device 110 and/or steam flow control system 107 may be taken into account when the steam flow is adjusted. In this regard, the steam flow may be adjusted more aggressively in order to achieve more responsive/substantially rapid steam flow adjustments. In one embodiment, given a set point of flow (e.g., manually by a technician, commanded by a control function, etc.), steam flow control system 107 and/or computing device 110 may optimize valve response based on flow model 132. Steam flow control system 107 may generate flow model 132 in real-time. In one embodiment, computing device 110 may store flow model 132, operational data 134 and/or system data 136 in any of memory 112 or storage system 122 for use in future modeling and/or analysis. Steam flow control system 107 may be periodically updated based upon previously obtained data, previously generated flow models, and/or system specific adjustments. In one embodiment, steam flow control system 107 and/or computing device 110 may include a neural network adapted to update steam flow control system 107 based upon previously obtained data and/or modeling results.

In one embodiment, computing device 110 may adjust the steam flow based on a flow model 132 generated by steam flow control system 107 via operational data 134. Computing device 110 may manipulate set of control valves 143, 145, and 147, in order to adjust the steam flow rate based on flow model 132. It is understood that location and number of set of control valves 143, 145, and 147, is merely illustrative, and that any number of control valves may be used at any location throughout power generation system 140 to manipulate steam flow through the system. Further, each of the control valves 143, 145, and 147, may be adjusted as desired to control the amount of steam that is allowed to pass through control valves 143, 145, and 147. For example, in order to increase the flow rate of steam through a control valve, the control valve may be adjusted to a more open position than the current position of the valve. As another example, in order to decrease the steam flow rate through a valve, the valve may be adjusted to a more closed position than that of the current position of the valve. As desired, control valves 143, 145, and 147, may be controlled independent of one another. For example, one control valve may open while the other control valves close, with the result of either a net increase or a net decrease in steam flow through power generation system 140. Additionally, in some embodiments, control valves 143, 145, and 147, may include one or more processor or microprocessor driven control units that control operation of the valves. As desired, these control units may provide information associated with control valves 143, 145, and 147 to other components of environment 100, for example, computing device 110.

In one embodiment, computing device 110 may adjust control valves 143, 145, and 147, to predictively control and adjust steam flow through power generation system 140. In one embodiment, computing device 110 may, based upon a prediction by flow model 132, initially undershoot a target flow rate for the steam flow, rapidly closing at least one of control valves 143, 145, and 147, such that a nominal flow rate through control valves 143, 145, and 147, is set below the target flow rate. Computing device 110 may then, based upon a prediction by flow model 132, forecast the steam flow rate decay in power generation system 140, and anticipatorily reopen at least one of control valves 143, 145, and 147, before the steam flow rate undershoots the target flow rate. This reopening of at least one of control valves 143, 145, and 147, attains a nominal flow rate through control valves 143, 145, and 147 which is substantially equivalent to the target flow rate. In another embodiment, computing device 110 may, based upon a prediction by flow model 132, initially overshoot a target flow rate for the steam flow, rapidly opening at least one of control valves 143, 145, and 147, such that a nominal flow rate through control valves 143, 145, and 147, is set above the target flow rate. Computing device 110 may then, based upon a prediction by flow model 132, forecast the steam flow rate increase in power generation system 140, and anticipatorily reclose at least one of control valves 143, 145, and 147, before the steam flow rate overshoots the target flow rate. This reclosing of at least one of control valves 143, 145, and 147, attains a nominal flow rate through control valves 143, 145, and 147, which is substantially equivalent to the target flow rate. In one embodiment, computing device 110 may use flow model 132 to enable island mode operation of power generation system 140 and/or steam turbine 80.

In one embodiment, computing device 110 and steam flow control system 107 may process operational data 134 and system data 136 to model steam flow through power generation system 140. System data 136 may include any other suitable data for power generation system 140, steam turbine 80, and/or the steam flow including, for example, control valve data (e.g., valve size, valve shape, etc.), turbine component data (e.g., conduit diameters, conduit lengths, steam volume shapes, nozzle size, etc.), etc. System data 136 may be stored on computing device 110, memory 112, storage system 122 and/or other storage devices communicatively connected to computing device 110. Steam flow control system 107 may process operational data 134 and/or system data 136 in order to facilitate modeling and/or predicting the behavior and/or flow of steam through power generation system 140 and generate flow model 132. In one embodiment, flow model 132 may model the behavior and/or operation of various components of power generation system 140 including control valves 143, 145, and 147. It is understood that any number or style of models may be processed and/or generated by computing device 110 and steam flow control system 107, these models predicting steam flow behavior and/or component behavior for the entire power generation system 140 and/or portions thereof.

In any event, computing device 110 can comprise any general purpose computing article of manufacture capable of executing computer program code installed by a user (e.g., a personal computer, server, handheld device, etc.). However, it is understood that computing device 110 is only representative of various possible equivalent computing devices that may perform the various process steps of the disclosure. To this extent, in other embodiments, computing device 110 can comprise any specific purpose computing article of manufacture comprising hardware and/or computer program code for performing specific functions, any computing article of manufacture that comprises a combination of specific purpose and general purpose hardware/software, or the like. In each case, the program code and hardware can be created using standard programming and engineering techniques, respectively. In one embodiment, computing device 110 may be/include a distributed control system. In another embodiment, computing device 110 may be integral to a steam turbine. In another embodiment, computing device 110 may be a part of power generation system 140. It is understood that power generation system 140 may include an number of pipes, turbines, control valves, conduits, etc. and Turning to FIG. 3, an illustrative method flow diagram is shown according to embodiments of the invention: In process P1, steam flow control system 107 is initiated on computing device 110 to begin modeling and control operations for power generation system 140. That is, either an automatic/scheduled adjustment to the steam flow of power generation system 140, a condition dictated adjustment to the steam flow of power generation system 140 or a manual/user-commanded adjustment of the steam flow may be performed by computing device 110. Following process P1, in process P2, computing device 110 obtains operational data from power generation system 140. Operational data may be obtained from at least one of: memory 112, storage system 122, and/or set of sensors 170. Operational data may include: steam flow rate, steam flow temperature, steam flow pressure, control valve positions, steam volume temperature, steam volume pressure, extraction steam flows, pressures, temperatures, mechanical data, etc. In one embodiment computing device 110 may monitor steam flow characteristics, steam volume characteristics and/or steam turbine operations via set of sensors 170 which may be disposed upon, within or in fluid communication with power generation system 140 and/or steam turbine 80. It is understood that set of sensors 170 may comprise any number of similar or varied sensors (e.g. pressure sensor, temperature sensor, humidity sensor, etc.) adapted to monitor steam flow characteristics and/or steam turbine operations. Set of sensors 170 may record/read operational data for steam turbine 80 and/or power generation system 140. In one embodiment, computing device 110 updates any of memory 112, storage system 122 and/or reference data 134 based upon readings by set of sensors 170.

In one embodiment, real-time readings are used to update operational data 134 and the existing steam flow model 132 in real-time. These readings are saved in any of memory 112 and storage system 122 to enhance future steam flow models by computing device 110 and/or steam flow control system 107. In one embodiment, these readings are factored into the generation of future flow models 132 by computing device 110. These readings may be used by computing device 110 to generate a steam flow versus operating parameter(s) characteristic (e.g., control valve position(s)) which may be used in real-time to adjust the operation of power generation system 140. In one embodiment, computing device 110 analyzes the sensor readings (e.g., determining an accuracy of the steam flow model, monitoring steam volume pressure, etc.). In one embodiment, computing device 110 continues to adaptively model steam flow through steam turbine 80 and adjust the operational steam flow and corresponding gas turbine operating parameter(s) to substantially meet plant demands.

In one embodiment, following process P2, in process P2', computing device 110 connects with memory 112 and/or storage system 122, to access system data 136 to assist with processing operational data 134 obtained from power generation system 140 and generate a flow model 132 of steam flow characteristics.

In any event, following either of process of P2 or process P2$^{I}$, in process P3, computing device 110 processes operational data 134 to generate a flow model 132 which demonstrates flow characteristics for a variety of turbine loads, operating parameter ranges, and/or control valve positions. In one embodiment this may include a standard data reduction process. Computing device 110 may process operational data to interpret the data such that it can then be used as input to flow model 132, sent to a display, and/or stored for later use. The range of the selected flow rates and/or operating condition(s) including, but not necessarily limited to the determined optimal flow rate for the steam. In one embodiment, computing device 110 and/or PU 114 may access any of: a flow look-up table, a pre-generated flow rate curve, a pre-generated steam pressure curve, and/or stored steam flow data. Computing device 110 and/or PU 114 may compare the stored reference data and/or operational data 134 to generate steam flow predictions for a set of control valve positions and/or turbine operating parameter(s) ranges. In one embodiment, computing device 110 and/or PU 114 may input operational data 134, the allowable steam flow rate, and/or control valve adjustments/positions into memory 112 and/or storage system 122 to obtain/generate flow model 132.

Following process P3, in process P4, computing device 110 analyzes flow model 132 to determine a target steam flow rate and/or adjustments (e.g., control valve position adjustments) to power generation system 140 to achieve the target steam flow rate. In one embodiment, computing device 110 may automatically adjust control valves based on flow model 132 via a set of actuators. In one embodiment, computing device 110 may display the flow model 132 for the steam turbine and/or corresponding turbine operating condition(s) on a graphical user interface (Shown in FIG. 4). In one embodiment, computing device 110 may display the flow rate model as a set of curves. In another embodiment, computing device 110 may display the flow rate model as a set of data points within a table. Graphical user interface 130 may include other power generation system 140 or turbine parameters as would be valuable for operator guidance in system and/or power plant operation. In one embodiment, computing device 110 may display the real-time steam flow values obtained from set of sensors 170 on the graphical user interface. In one embodiment, the real-time steam flow values may be displayed comparatively with the model steam flow values on the graphical user interface. In one embodiment, a user may monitor the real-time steam flow values and adjust control valve positions within an allowable operational range on the graphical user interface. The allowable operational range determined by computing device 110 based on flow model 132. In one embodiment, computing device 110 may analyze flow model 132 to determine an efficient set of control valve adjustments which will attain the target steam flow rate. In one embodiment, this may enable more aggressive adjustment of control valves.

Following process P4, in process P5, computing device 110 adjusts steam flow in steam turbine 80 to attain the target steam flow. In one embodiment, computing device 110 adjusts the control valves based on steam flow control system 107 and/or flow model 132. Following process P5, in process P6$^{I}$, steam flow control system 107 loops back to step P2 to adjust and/or further manipulate steam flow control system 107 and/or power generation system 140. Alternatively, following process P5, in process P6$^{II}$, steam flow control system 107 is stopped.

The data flow diagram and block diagrams in the FIGURES illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the FIGURES. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

Figure 4:
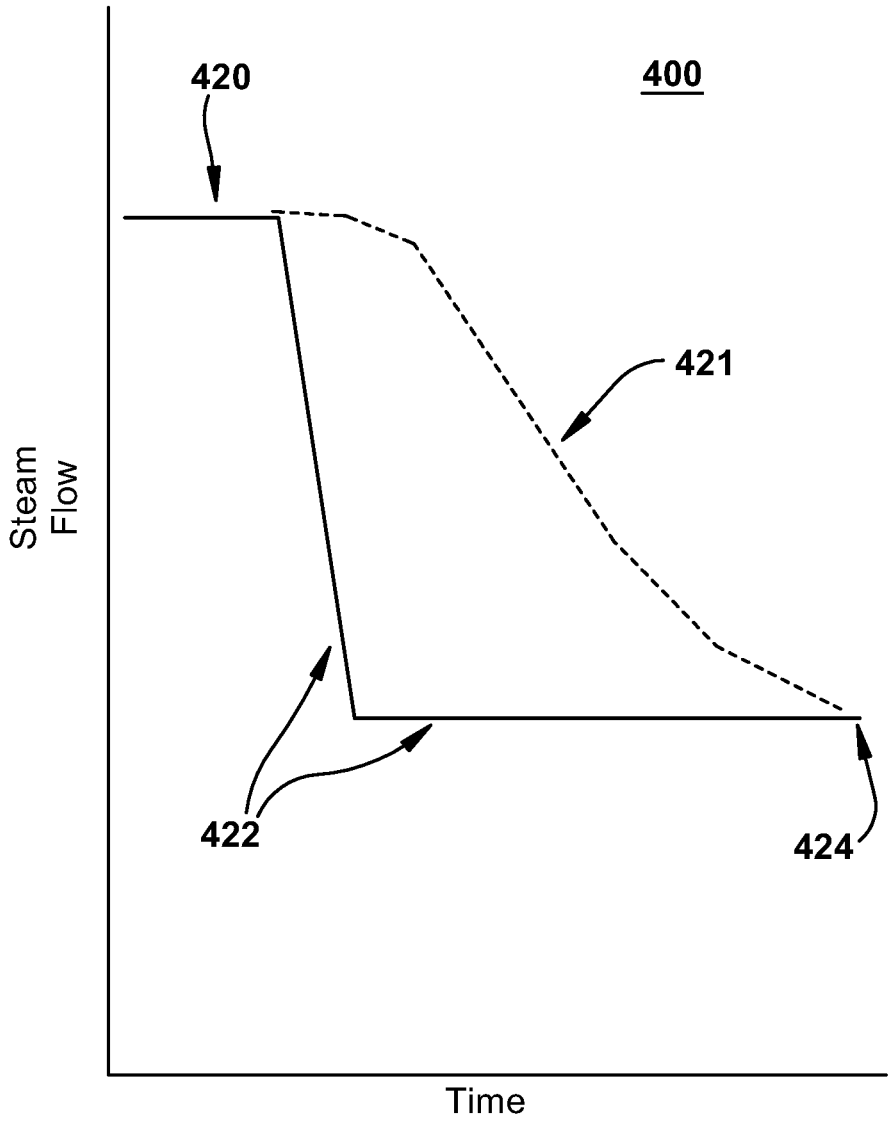
FIG. 4 shows a schematic illustration of a user interface.

Turning to FIG. 4, a schematic illustration of a User Interface (UI) 400 is shown. UI 400 shows rate limited control of control valves and includes an actual steam flow rate curve 421 (shown in phantom) and a nominal steam flow rate curve 422 both plotted against time. Nominal steam flow rate curve 422 indicates the calculated steam flow rate through steam turbine 80 based on a position of set of control valves controlled by steam flow control system 107. As can be seen in UI 400, nominal steam flow rate curve 422 and actual steam flow rate curve 421 have identical flow rate values at first flow point 420 which indicates the initial steam flow rate in steam turbine 80 and at second flow point 424 which indicates the target steam flow rate in steam turbine 80. However, the variance between nominal steam flow rate curve 422 and actual steam flow rate curve 421 during flow rate transition/as time progresses from first flow point 420 to second flow point 424 shows the response lag of the steam flow and steam volumes. Nominal steam flow rate curve 422 represents the steam flow at the set of control valves feeding a compressible volume, and actual steam flow rate curve 421 represents the steam flow exiting the compressible volume. During steam turbine operation and adjustment, values for nominal steam flow rate curve 422 may vary from values of actual steam flow rate curve 421. Flow model 132 may model and predict these variances enabling more aggressive control of values for actual steam flow rate curve 421 and the steam flow exiting the compressible volume.

Figure 5:
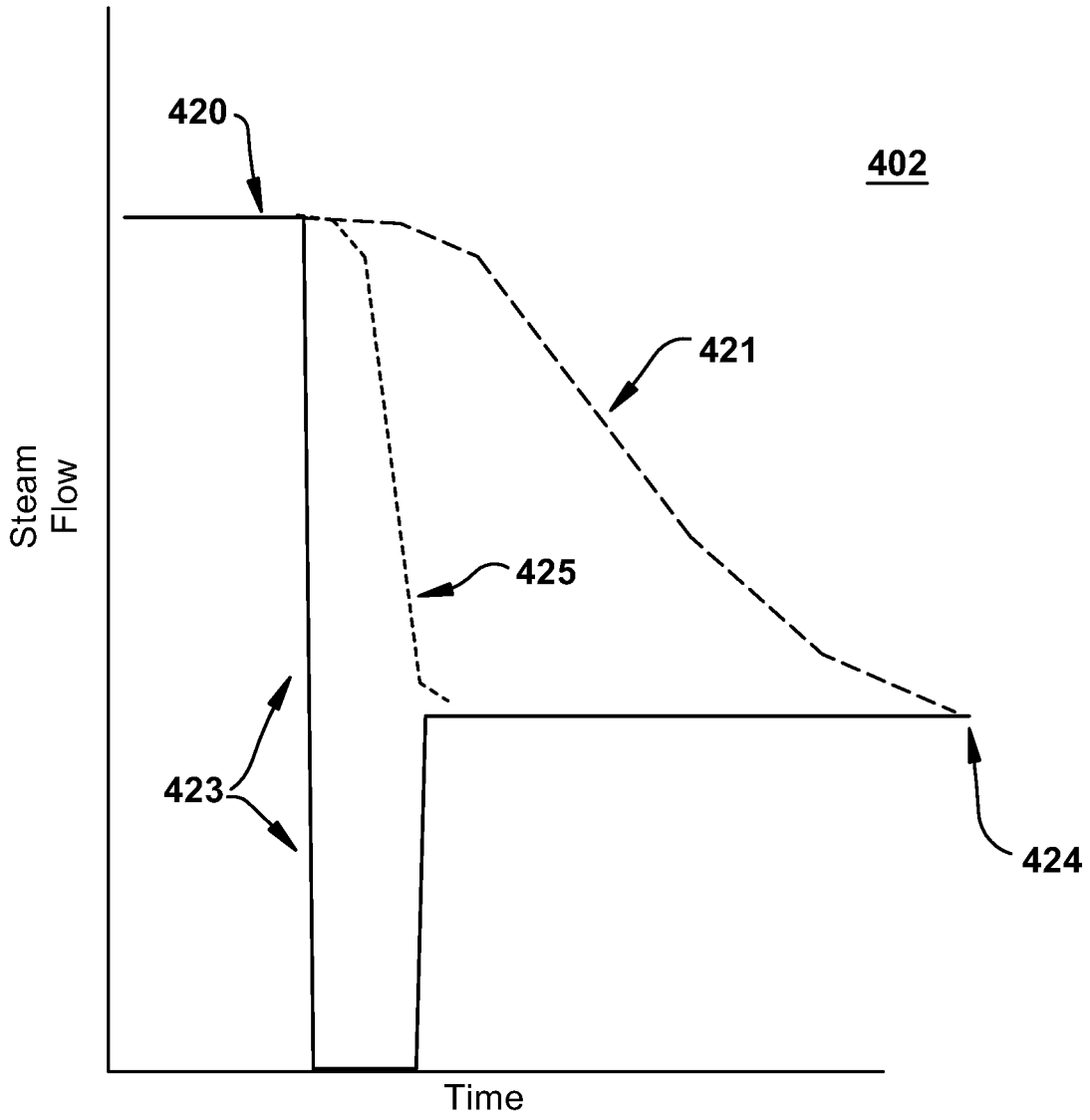
FIG. 5 shows a schematic illustration of a user interface according to embodiments of the invention.

Turning to FIG. 5, a schematic illustration of a User Interface (UI) 402 is shown according to embodiments of the invention. UI 402 shows model based control of control valves and an anticipated decrease in the response time of the steam flow as represented by model based control curve 425. In this embodiment, control valves are adjusted by steam flow control system 107 based upon a flow model 132, and as such the model based nominal steam flow rate curve 423, drops below target steam flow rate 424 for a period of time and then, based upon flow model 132, is adjusted back up to the target flow rate. In another embodiment, user interface 402 may include an optimum adjustment indicator for notifying a user/operator as to the optimal system/valve adjustments to a modify a flow rate of the steam. In one embodiment, the operator may select the optimum valve adjustment indicator on user interface 402 to adjust the steam flow rate. Flow model 132 may model steam flow into a compressible volume (e.g., nominal steam flow rate curve 422) and out of the compressible volume (e.g., actual steam flow rate curve 421). Via this modeling, more aggressive control of the flow exiting the compressible volume may be enabled. It is understood that user interface 402 is only an exemplary embodiment of the invention, other forms, formats and/or styles of user interfaces may be included as is known in the art.

Figure 6:
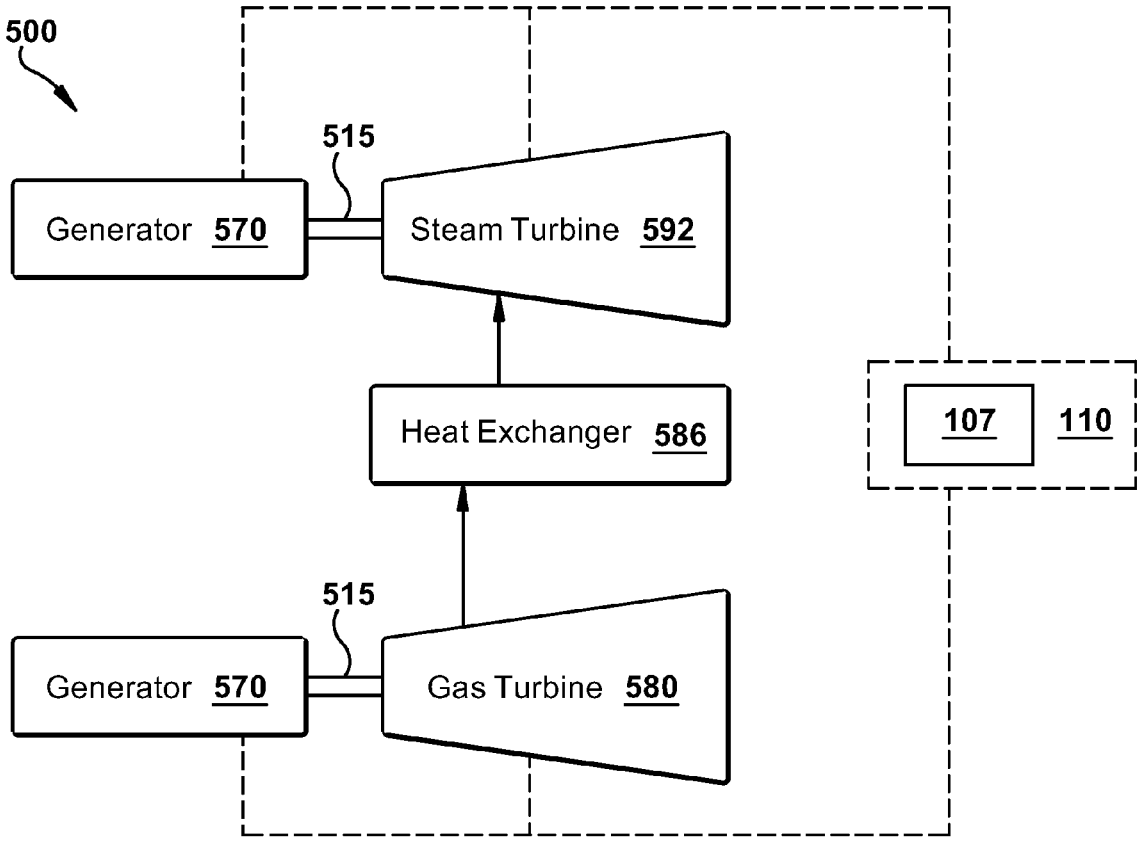
FIG. 6 shows a schematic view of portions of a multi-shaft combined cycle power plant in accordance with an aspect of the invention.

Turning to FIG. 6, a schematic view of portions of a multi-shaft combined-cycle power plant 500 is shown. Combined-cycle power plant 500 may include, for example, a gas turbine 580 operably connected to a generator 570. Generator 570 and gas turbine 580 may be mechanically coupled by a shaft 515, which may transfer energy between a gas turbine 580 and generator 570. Also shown in FIG. 6 is a heat exchanger 586 operably connected to gas turbine 580 and a steam turbine 592. Heat exchanger 586 may be fluidly connected to both gas turbine 580 and steam turbine 592 via conventional conduits (numbering omitted). Heat exchanger 586 may be a conventional heat recovery steam generator (HRSG), such as those used in conventional combined-cycle power systems. As is known in the art of power generation, HRSG 586 may use hot exhaust from gas turbine 580, combined with a water supply, to create steam which is fed to steam turbine 592. Steam turbine 592 may optionally be coupled to a second generator system 570 (via a second shaft 515). Any of generator system 570, gas turbine 580, HRSG 586, and steam turbine 592 may be communicatively connected to steam flow control system 107 via computing device 110 of FIG. 2 or other embodiments described herein. It is understood that generators 570 and shafts 515 may be of any size or type known in the art and may differ depending upon their application or the system to which they are connected. Common numbering of the generators and shafts is for clarity and does not necessarily suggest these generators or shafts are identical. Generator system 570 and second shaft 515 may operate substantially similarly to generator system 570 and shaft 515 described above. In one embodiment of the present invention (shown in phantom), steam flow control system 107 may be used, via computing device 110 to control steam flow to and/or through steam turbine 592.

Figure 7:
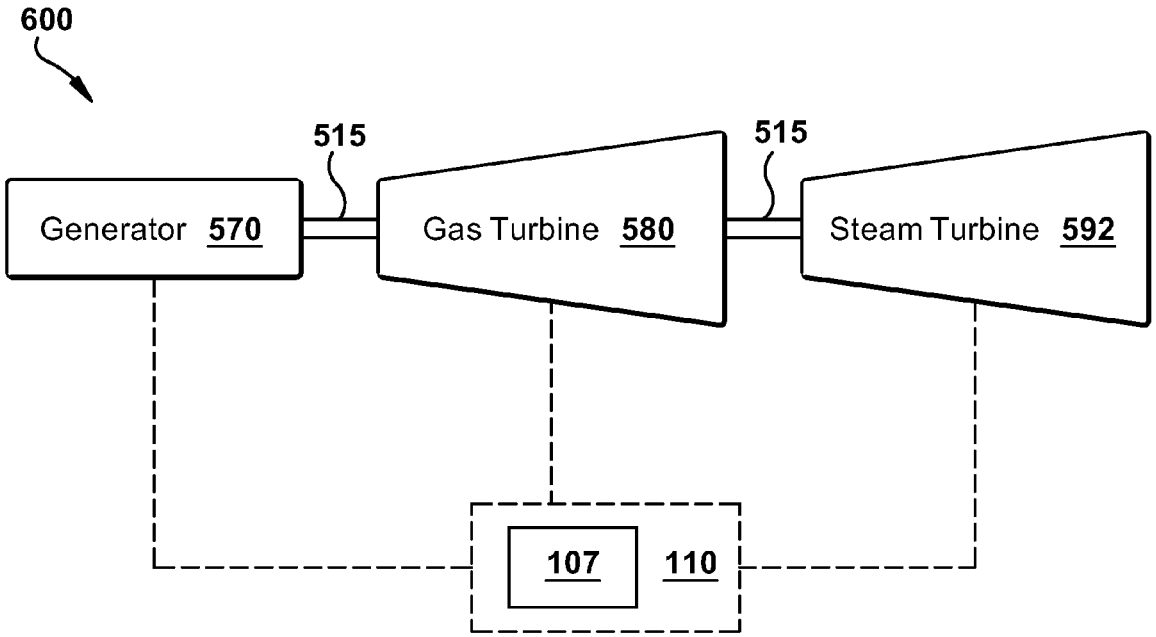
FIG. 7 shows a schematic view of portions of a single-shaft combined cycle power plant in accordance with an aspect of the invention.

In another embodiment, shown in FIG. 7, a single-shaft combined-cycle power plant 600 may include a single generator 570 coupled to both gas turbine 580 and steam turbine 592 via a single shaft 515. Steam turbine 592 may be operably connected to steam flow control system 107 via computing device 110 of FIG. 2 or other embodiments described herein.

The steam flow control systems and methods of the present disclosure are not limited to any one power generation system, combined cycle power generation system, turbine or other system, and may be used with other power systems. Additionally, the system of the present invention may be used with other systems not described herein that may benefit from the responsive and stable steam flow operation provided by the steam flow control system described herein.

As discussed herein, various systems and components are described as "obtaining" and/or "transferring" data (e.g., operational data, component temperatures, system specifications, etc.). It is understood that the corresponding data can be obtained using any solution. For example, the corresponding system/component can generate and/or be used to generate the data, retrieve the data from one or more data stores or sensors (e.g., a database), receive the data from another system/component, and/or the like. When the data is not generated by the particular system/component, it is understood that another system/component can be implemented apart from the system/component shown, which generates the data and provides it to the system/component and/or stores the data for access by the system/component.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A steam turbine control system comprising:

at least one sensor adapted to obtain operational data for a steam flow in a power generation system; and at least one control valve for controlling a steam flow rate of steam through a steam turbine;

a computer communicatively connected to the at least one sensor, and the at least one control valve, the computer is configured to generate a flow model by processing the operational data for the steam flow, wherein the flow model includes:

a the first steam flow rate curve having an associated first time delay between an initial steam flow rate and a target steam flow rate for setting a steam flow rate setpoint to the target steam flow rate, and a second steam flow rate curve having an associated second time delay between the initial steam flow rate and the target steam flow rate for setting the steam flow rate setpoint to a value other than the target steam flow rate, and setting the steam flow rate setpoint to the target steam flow rate before the target steam flow rate is reached;

the computer is further configured to adjust the at least one control valve of the power generation system based at least in part on the second steam flow rate curve of the flow model to reduce a time delay between the adjusting of the control valve and the steam flow reaching the target flow rate.

2. The steam turbine control system of claim 1, wherein the operational data includes at least one of: a steam flow rate, a steam flow temperature, a steam flow pressure, a control valve position, a steam volume temperature, and a steam volume pressure.

3. The steam turbine control system of claim 1, wherein the computer adjusts the steam flow by:

setting a position of the at least one control valve in the power generation system such that a steam flow rate through the at least one control valve is greater than the target steam flow rate; and adjusting the position of the at least one control valve based upon the second steam flow rate curve to reach the target steam flow rate.

4. The steam turbine control system of claim 1, wherein the computer adjusts the steam flow by:

setting a position of the at least one control valve in the power generation system such that a steam flow rate through the control valve is less than the target steam flow rate; and adjusting the position of the at least one control valve based upon the second steam flow rate curve to reach the target steam flow rate.

5. The steam turbine control system of claim 1, further comprising a set of sensors communicatively connected to the computing device and operatively connected to the power generation system, the set of sensors configured to obtain operational data.

6. The steam turbine control system of claim 1, wherein the steam flow passes through a compressible volume.

* * * * *

UNITED STATES PATENT AND TRADEMARK OFFICE

CERTIFICATE OF CORRECTION

PATENT NO. : 8,925,319 B2
APPLICATION NO. : 13/588127
DATED : January 6, 2015
INVENTOR(S) : Snider et al.

It is certified that error appears in the above-identified patent and that said Letters Patent is hereby corrected as shown below:

In the specification,

In Column 9, Line 34, delete "P2'," and insert -- $P2^{I}$, --, therefor.

In the claims,

In Column 12, Line 64, in Claim 1, delete "a the" and insert -- a --, therefor.

Signed and Sealed this
Fifth Day of May, 2015

Michelle K. Lee

Michelle K. Lee
*Director of the United States Patent and Trademark Office*